US006931778B1

(12) United States Patent
Nelson et al.

(10) Patent No.: US 6,931,778 B1
(45) Date of Patent: Aug. 23, 2005

(54) CLAMP FOR WEAPON MOUNT

(75) Inventors: John Carl Nelson, Salem, VA (US); Stephen Lesniowski, Check, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 75 days.

(21) Appl. No.: 10/671,630

(22) Filed: Sep. 29, 2003

Related U.S. Application Data

(62) Division of application No. 09/847,293, filed on May 3, 2001, now Pat. No. 6,637,144.

(51) Int. Cl.[7] ..... F41C 3/14
(52) U.S. Cl. ..... 42/120; 42/148; 42/124
(58) Field of Search ..... 42/120, 148, 124

(56) References Cited

U.S. PATENT DOCUMENTS

| | | | | | |
|---|---|---|---|---|---|
| 1,856,549 | A | | 5/1932 | Griffin et al. | 42/127 |
| 3,555,687 | A | | 1/1971 | Joseph | 42/124 |
| 3,877,166 | A | * | 4/1975 | Ward | 42/127 |
| 4,310,980 | A | * | 1/1982 | Pilkington | 42/127 |
| 4,367,606 | A | | 1/1983 | Betchel | 42/127 |
| 4,501,071 | A | | 2/1985 | Manske | 42/127 |
| 4,707,772 | A | | 11/1987 | Jimenez et al. | 362/110 |
| 4,873,799 | A | | 10/1989 | Flink | 52/169.8 |
| 5,155,915 | A | | 10/1992 | Repa | 42/127 |
| 5,276,988 | A | * | 1/1994 | Swan | 42/127 |
| 5,533,292 | A | | 7/1996 | Swan | 42/123 |
| 5,570,529 | A | * | 11/1996 | Amelino | 42/124 |
| 5,606,818 | A | * | 3/1997 | Hardee | 42/124 |
| 5,680,725 | A | * | 10/1997 | Bell | 42/127 |
| 6,363,648 | B1 | | 4/2002 | Kranich et al. | 42/114 |
| 6,442,883 | B1 | * | 9/2002 | Waterman et al. | 42/124 |
| 6,446,377 | B1 | | 9/2002 | Hollenbach et al. | 42/148 |
| 6,606,813 | B1 | * | 8/2003 | Squire et al. | 42/90 |

OTHER PUBLICATIONS

GlobalSpec: About Spring Washers□□http://mechanical–components.globalspec.com/LearnMore/Mechanical_Components/Springs/Washer_Springs.*

* cited by examiner

*Primary Examiner*—Michael J. Carone
*Assistant Examiner*—M. Thomson
(74) *Attorney, Agent, or Firm*—Edell Shapiro & Finnan, LLC

(57) ABSTRACT

A weapon mount for mounting a night vision device to the receiver rail of a weapon. A self-device adjusting cam operated connection device is present at one end region of the mount for attaching to the receiver rail, while the night vision device is connected at the other end region of the mount with a knob operated mounting screw. The knob and mounting screw are a one piece design and the mounting screw is captivated by an E-clip. The cam operated connection device may be adjusted to accommodate different size receiver rails by the provision of compressible means, such as Belleville washers.

18 Claims, 4 Drawing Sheets

CLAMP FOR WEAPON MOUNT

The present application is a divisional of U.S. application Ser. No. 09/847,293 filed May 3, 2001, now U.S. Pat. No. 6,637,144, which is incorporated herein by reference in its entirety.

FIELD OF THE INVENTION

The present invention is directed to a weapon mount for mounting an auxiliary device such as a night vision device to the receiver rail of a weapon, such as a rifle.

BACKGROUND OF THE INVENTION

It is known to mount a night vision device on a weapon such as a rifle to enable a soldier to accurately aim the weapon in darkness. Weapon mounts for such purpose include means for fastening the night vision device to the mount, and for fastening the mount to the weapon's receiver rail. It is important for the mounting devices to be easy and quick to operate while providing a secure and robust mechanical attachment. In order for the shooter to maintain his normal shooting position, a suitable weapon mount must also provide proper vertical positioning of the night vision device and allow for the necessary proper fore/aft adjustment.

The present invention has particular applicability to mounting an AN/PVS-14 Monocular Night Vision Device (MNVD) to the receiver rail of an M16/M4 carbine. The prior art weapon mounts do not allow for proper mounting of the AN/PVS-14 when used in conjunction with the Back-up Iron Sight (BUIS). The U.S. military desires for the BUIS to remain constantly mounted on the weapon during both daytime and nighttime operations. The AN/PVS-14 night vision device must be mounted in front of the BUIS, which is usually mounted at the most rearward portion of the M16/M4 receiver rail. However, if the night vision device is physically in front of the BUIS, the sight is too far forward and the user is unable to position his eye at the desired eye relief distance of the sight while maintaining his natural shooting position.

The weapon mounts of the prior art have many disadvantages, including the following:

(a) They do not vertically align the AN/PVS-14's optical axis with the M68 Close Combat Optic;

(b) They do not possess a quick attachment/release mechanism that will accommodate maximum to minimum dimension Picatinny Rails (the nickname for the standard M16/M4 receiver rail).

(c) They employ either complicated ratcheting mechanisms or a non-compensating cam for rail variation to attach the night vision device to the weapon's receiver rail;

(d) They utilize a thumbscrew attachment for securing the weapon mount to the night vision device which is either of a multi-piece design assembled with screw fasteners, or does not have a permanent retention to the mount.

(e) They do not allow the combined mounting of the AN/PVS-14 with a 3× Magnifier Lens, M68 Close Combat Optic and BUIS on a single M16/M4 receiver rail; and (f) They will not fit on a standard Weaver Rail in addition to the Picatinny Rail because they employ a #10 rail bolt or rectangular-slot locating bar of similar size as the rail/slot interface.

SUMMARY OF THE INVENTION

In accordance with a first aspect of the present invention, a weapon mount for mounting a night vision device to the receiver rail of a weapon is provided which comprises a mounting member having first and second end regions, wherein the first end region bears a cam operated connection device for attaching to the receiver rail, and wherein the second end region bears a mounting screw for attaching to the night vision device, there being an intermediate portion between the first and second end regions having a right angle bend.

The structure described above may be used to position the night vision device above the BUIS, providing clearance for the BUIS restrictive space envelope, and enabling the correct fore/aft positioning of the night vision device on the weapon receiver rail for optimal shooting location and eye relief distance.

In accordance with a second aspect of the invention, a self-adjusting cam is provided to allow for quick mounting/removal of the weapon mount to the weapon.

In accordance with a third aspect of the invention, a clamping arrangement is provided which includes compressible means, allowing the mount to be securely attached to the weapon despite varying rail dimensions.

Other and further aspects and features of the invention will become apparent by reference to the following description.

BRIEF DESCRIPTION OF THE DRAWINGS

The invention will be better appreciated by referring to the accompanying drawings, wherein.

DETAILED DESCRIPTION OF PREFERRED EMBODIMENT

Figure 1:
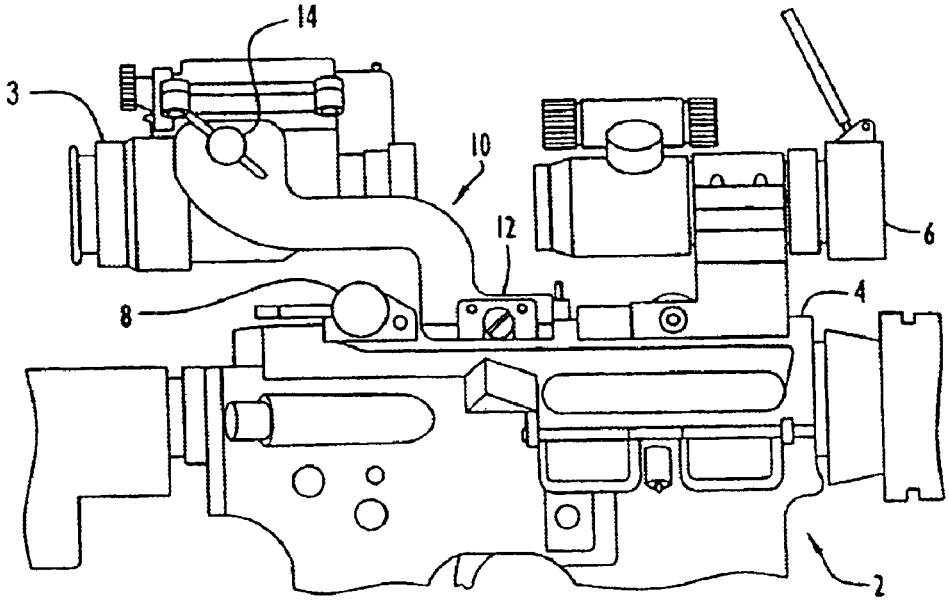
FIG. 1 shows a night vision device mounted on a weapon's receiver rail with an embodiment of the weapon mount of the invention.

Referring to FIG. 1, a weapon 2 having a receiver rail 4 is shown. The cross-section of the receiver rail 4 is shown more clearly in FIG. 8. In the preferred embodiment, the receiver rail is the M16/M4 receiver rail, although the invention may be employed in connection with other receiver rails also.

A backup iron sight (BUIS) 8 is mounted on the weapon and in fact, the U.S. military desires that the BUIS be constantly mounted on the weapon during daytime and nighttime operations. Since the BUIS Is mounted at the extreme rear of the weapon's receiver rail, the night vision device must be mounted in front of the BUIS on the weapon's receiver rail. However, in this case, without the use of the present invention, the sight is too far forward and the user is unable to position his eye at the desired eye relief distance of the sight and maintain his natural shooting distance.

In accordance with an aspect to the invention, a mounting member 10 is provided, which is arranged to position the night vision device 3 above the "stay out" space of the BUIS. It also allows for proper fore/aft adjustment of the night vision device and optimizes the vertical alignment with the optical axis of the close combat optic 6. The night vision device may be an AN/PVS-14 and the close combat optic may be an M68.

Figure 2:
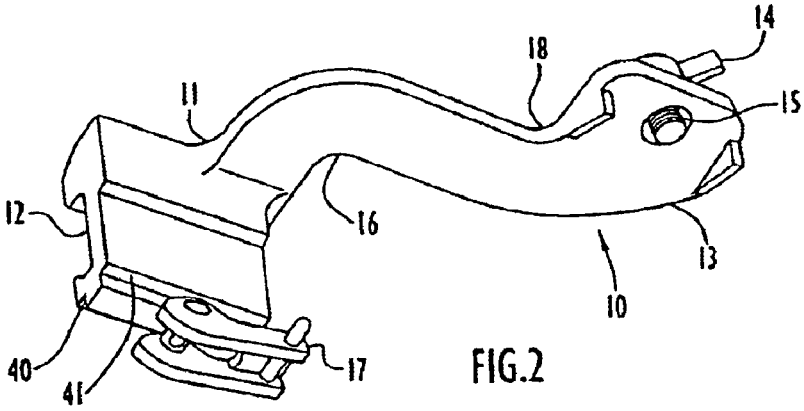
FIG. 2 shows a weapon mount in accordance with an embodiment of the invention.

Referring to FIG. 2, mounting member 10 is seen to have end regions 11 and 13, with an intermediate portion there between having right angle bends 16 and 18. If the mounting member is considered to be divided by the right angle bends, the portions to either sides of the bends are arranged to have relative lengths so as to properly position the night vision device as exemplified in the Figures.

Additionally, a first end region 11 of the mounting member 10 bears a cam operated connection device 12, for attachment of the mounting member 10 to the receiver rail. The connection device 12 is operated by cam 17. A second end region 13 of the mounting member bears a mounting screw 15 for attachment of the mounting member 10 to the night vision device. The mounting screw 15 is operated by a "T" knob 14.

Figure 3:
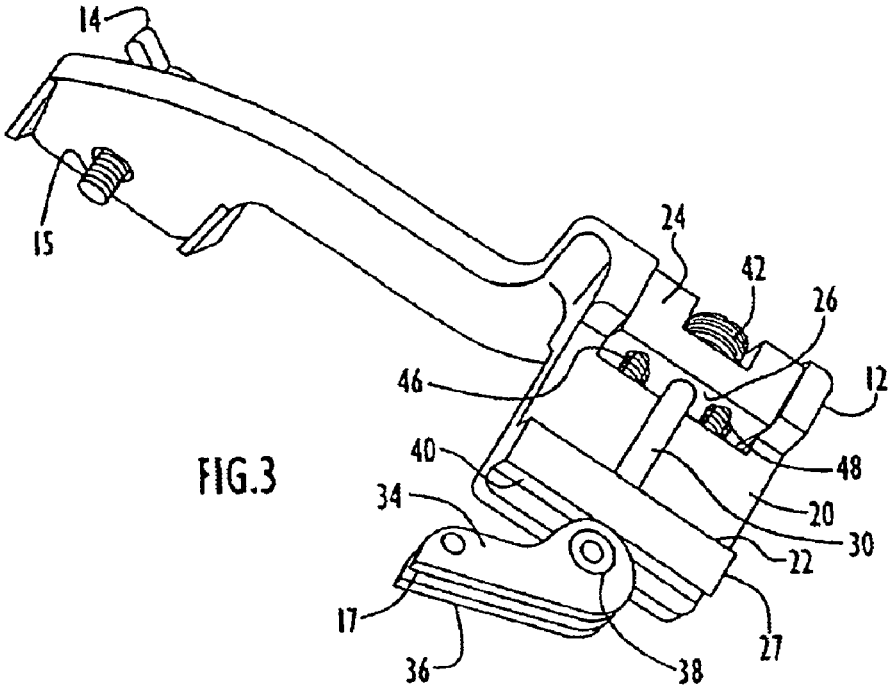
FIG. 3 shows a cam operated device for connecting to the weapon receiver's rail in accordance with an embodiment of the invention.

Referring to FIG. 3, an embodiment of a cam operated connection device 12, which comprises an aspect of the present invention, is shown. The connection device is comprised of a clamp 24 which is operated between extended and retracted positions. In the retracted position, the clamp is held securely on the receiver rail, while to release the clamp it is moved to the extended position.

Figure 4:
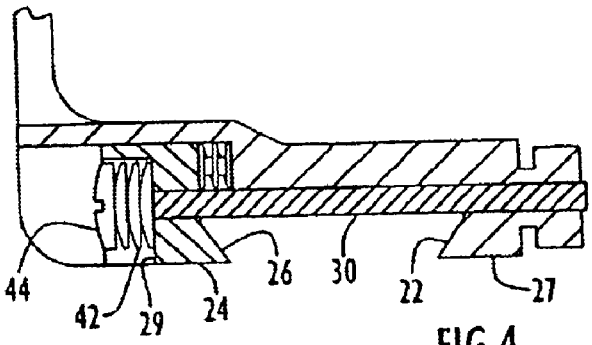
FIG. 4 shows the disposition of the rail bolt to the cam pivot pin.

The surfaces of the connection device which embrace the receiver rail are base 20, inside surface 22 of abutment 27, and inside surface 26 of clamp 24. Inside surfaces 22 and 26 are chamfered to correspond with the chamfering of the weapon receiver rail, previously described (See FIG. 4). Rail bolt 30 is situated in a concave recess in base 20, and runs between the pivot pin 38 of the cam, and the outside surface 29 of clamp 24 which is opposite inside surface 26. As shown in FIG. 4, the rail bolt 30 is connected to the pivot pin 38 (e.g., by threading), while the pivot pin itself may be part of the same piece which includes abutment and base 20. The receiver rail has a concave recess into which the rail bolt fits when the device is clamped (not shown). This allows for the cam and pivot to be set precisely to allow mounting to the maximum size mounting rail.

There are a pair of guide pins 46 threaded into the clamp, which allow the clamp to slide back and forth as the pins engage two cylindrical bores in base 20. Each guide pin is surrounded by a spring 48 to force the clamp outwardly when the cam is not engaged. There are compressible means, for example, Belleville washers, between bolt head 44 and the clamp.

In order to retract the clamp from its completely open position, the cam 17 would be rotated counterclockwise in FIG. 3, to move the pivot pin outwardly, thus pulling the rail bolt. When the cam is rotated, ears 34 and 36 work against ledges 40 and 41 (see FIG. 2) respectively, and the cam is rotated all the way to the locked position where the straight edges of the ears abut the surfaces 40 and 41. In order to release the clamp, the cam is rotated in the opposite direction. This mechanism provides for the mounting and removal of the weapon mount to be done very quietly if desired.

It is a feature of the invention that the cam is self adjusting, thus accommodating receiver rails of different sizes. This is accomplished by providing compressible means, such as Belleville washers 42, between rail bolt head 44 and the clamp. Additionally, the rail bolt can be loosened or tightened within certain limits while still retaining the clamping function. Thus, the effective distance between surfaces 26 and 22 when the clamp is in the retracted position can be controlled, with the result that the device can be used with receiver rails of different sizes. In lieu of Belleville washers, other compressible means which will be known to those skilled in the art, including but not limited to wavy washers, rubber gaskets, and custom spring pieces can be used.

Figure 5:
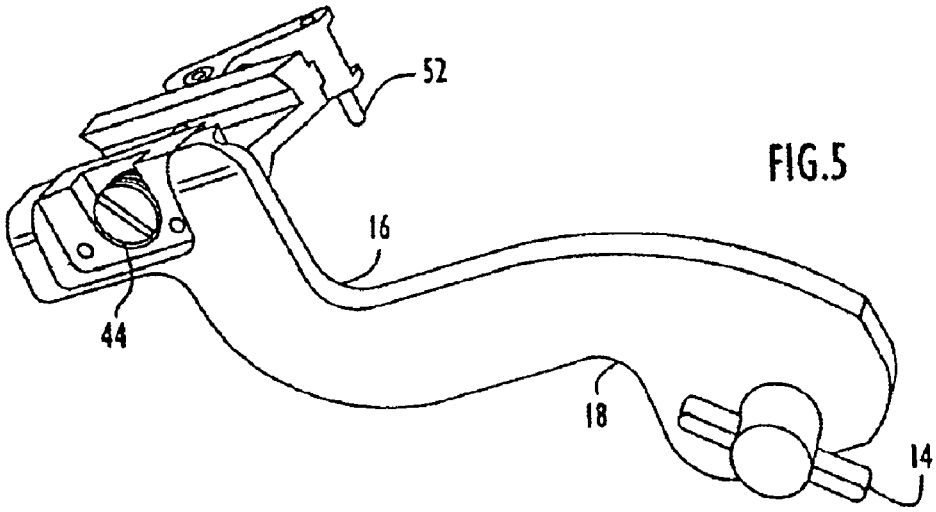
FIG. 5 shows the device from the opposite side as FIG. 3.

To disconnect from the receiver rail, the cam will release the clamp when rotated clockwise in FIG. 3, which can be easily effected by applying force to release rod 52, shown in FIG. 5. The release rod is designed to minimize snag potential.

Figure 6:
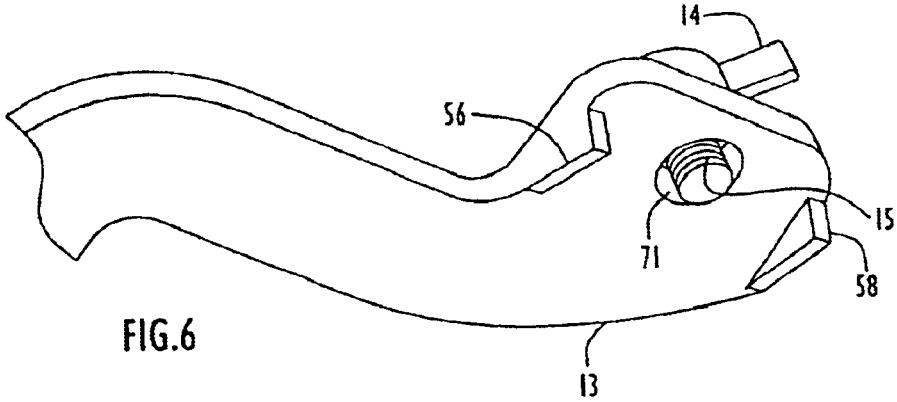
FIG. 6 shows the mounting screw and alignment protrusions.
Figure 7:
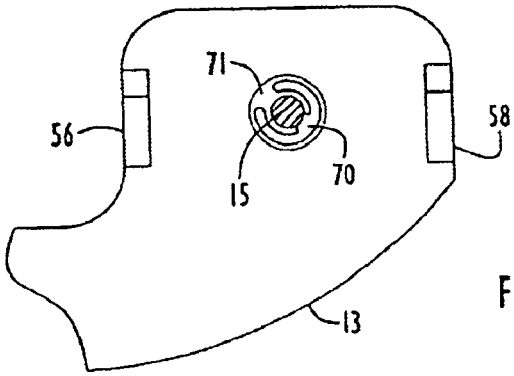
FIG. 7 shows the E clip for the mounting screw.
Figure 9:
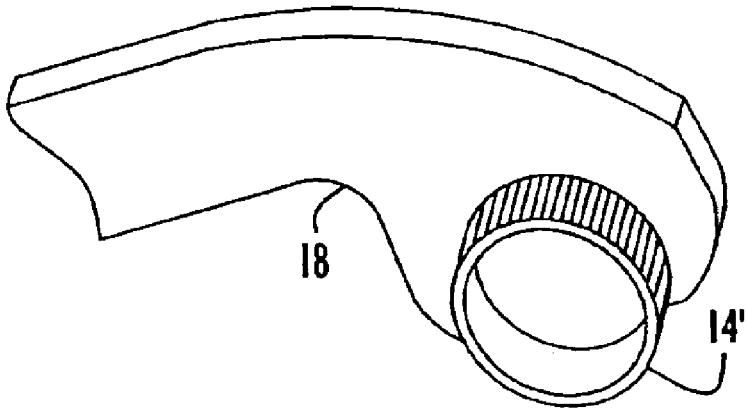
FIG. 9 shows an embodiment using a round knob for mounting to the night vision device.

FIG. 6 shows a mounting screw 15 which is used to connect the night vision device to the mounting member. The "T" knob 14 provides a mechanical advantage to the user which allows secure mechanical attachment of the night vision device. An E-clip 70, shown in FIG. 7, is provided in the bore 71 around screw 15 to prevent the mounting screw from detaching from mounting member 10 shown in FIG. 1. The two alignment protrusions 56 and 58, shown in FIG. 7, ensure that the night vision device is held securely, and help stabilize it during weapon shock. As an alternative to the "T" knob, a round knob 14' may be used, and this is depicted in FIG. 9. The round knob and mounting screw are of a one piece design, and the mounting screw is captivated in the bore by an E-clip, as shown in FIG. 7.

Figure 8:
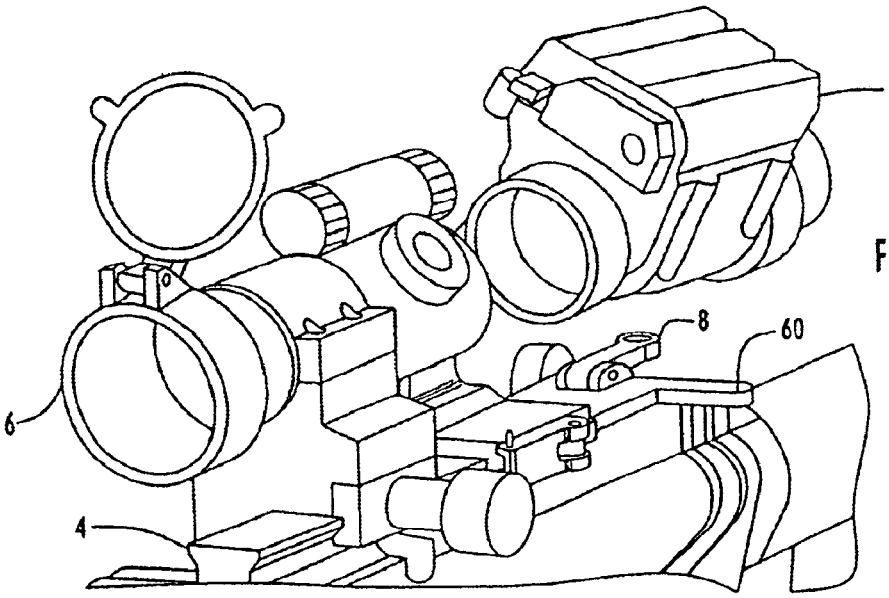
FIG. 8 shows the night vision device as properly mounted on the weapon's receiver rail.

FIG. 8 shows a weapon bearing the night vision device mounted as described herein, as seen from the other side shown in FIG. 1. It is seen that with the mounting scheme of the invention, access to the M16/M4 charging lever 60 is unimpeded. Additional advantages are that the weapon mount allows the combined mounting of the AN/PVS-14 with its 3× lens, the close combat optic and back-up iron sight on a single Picatinny Rail. The weapon mount will also fit on a standard Weaver Rail in addition to the Picatinny Rail by utilization of a #8 bolt as the rail/slot interface.

There has thus been described an improved weapon mount. While the invention has been described in connection with the mounting of a night vision device, it should be understood that it could be used or adapted to mount a different auxiliary device. Also, while the invention has been described in connection with a preferred embodiment, it should be understood that variations will occur to those skilled in the art, and the invention to be covered is defined in the claims which are appended hereto.

We claim:

1. A connection device for attaching to a receiver rail of a weapon, which receiver rail has a top surface and opposite side surfaces, comprising; a base surface and first and second side members for engaging in an operative position said surfaces of the receiver rail, wherein the base surface is for engaging the top surface of the receiver rail and the first side member is stationary and is for engaging one of the side surfaces of the receiver rail and the second side member is movable between an extended position where it does not securely engage the opposite side surface of the receiver rail and said operative position where it is retracted and securely engages said opposite side surface of the receiver rail, the second side member being part of a clamp which is connected to a bolt having an axial direction, wherein the clamp is pushed and pulled between said extended and retracted positions by pushing and pulling the bolt, and a cam which is rotatable in a plane in which said axial direction of said bolt lies for pushing and pulling the bolt.

2. The connection device of claim 1 wherein the first side member has an exterior surface and an interior surface, and wherein the cam has a camming surface which works against said exterior surface.

3. The connection device of claim 2 wherein the bolt has a first end which extends through the second side member and a second end, wherein there is compressible means around said bolt at said first end for exerting force on the clamp.

4. The connection device of claim 3 wherein said extended position and said retracted positions are the only stable positions of the clamp.

5. The connection device of claim 3 wherein the cam is rotatable by about 180°.

6. The connection device of claim 5 wherein the cam includes a pivot pin around which rotation of said camming surface occurs.

7. The connection device of claim 6 wherein the second end of the bolt operatively engages the cam for being pushed and pulled as the cam rotates.

8. The connection device of claim 7 wherein said camming surface is about circular in shape and the pivot pin is eccentrically mounted in relation to the circular shape.

9. The connection device of claim 8 wherein the cam includes a lengthwise extending operating lever.

10. The connection device of claim 9 wherein said operating lever is movable between respective positions generally parallel to said exterior surface of said first member which are about 180° apart and which correspond to respective stable positions of the clamp.

11. The connection device of claim 10 wherein the clamp is spring biased away from the first member.

12. The connection device of claim 11 wherein guide pins extend from the second member of the clamp which engage bores in the base.

13. The connection device of claim 12 wherein the spring biasing is effected by loading the guide pins with springs.

14. The connection device of claim 7 wherein the spring biasing is effected by loading the guide pins with springs.

15. The connection device of claim 9 wherein the bolt is secured to the pivot pin.

16. The connection device of claim 15 wherein said camming surface is one of a pair of camming surfaces of said cam, wherein said camming surfaces comprise a pair of parallel ears between which there is a space in which is situated the pivot pin, and wherein said exterior surface of said first member against which said camming surface works comprises a pair of ledges.

17. The connection device of claim 16 wherein the ledges are separated by an abutment which projects from the exterior surface of the first member, said abutment being in the space between the ears, wherein flat surfaces of the ears are adjacent respective flat surfaces of said abutment.

18. A connection device for attaching to a receiver rail of a weapon, which receiver rail has a top surface and opposite side surfaces, comprising; a base surface and first and second side members for engaging in an operative position said surfaces of the receiver rail, wherein the base surface is for engaging the top surface receiver rail and the first side member is stationary and is for engaging one of the side surfaces of the receiver rail and the second side member is movable between an extended position where it does not securely engage the opposite side surface of the receiver rail and said operative position where it is retracted and securely engages said opposite side surface of the receiver rail, the second side member being part of a clamp which is connected to a bolt having an axial direction, wherein the clamp is pushed and pulled between said extended and retracted positions by pushing and pulling the bolt, and a cam having a camming surface which works against an exterior surface of said first side member and which is rotatable in a plane in which said axial direction of said bolt lies for pushing and pulling the bolt, the bolt having a first end which extends through the second side member, and there being compressible means around the bolt at said first end for exerting force on the clamp.

* * * * *